US008708480B2

(12) United States Patent
Toya

(10) Patent No.: US 8,708,480 B2
(45) Date of Patent: Apr. 29, 2014

(54) RECORDING APPARATUS

(75) Inventor: Akihiro Toya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 250 days.

(21) Appl. No.: 13/417,617

(22) Filed: Mar. 12, 2012

(65) Prior Publication Data

US 2012/0236059 A1 Sep. 20, 2012

(30) Foreign Application Priority Data

Mar. 15, 2011 (JP) ..... 2011-056780

(51) Int. Cl.
*B41J 2/01* (2006.01)
*B41J 11/00* (2006.01)

(52) U.S. Cl.
CPC ..... *B41J 11/0085* (2013.01); *B41J 11/002* (2013.01)
USPC ..... 347/104

(58) Field of Classification Search
CPC ..... B41J 11/002; B41J 11/0085
USPC ..... 347/16, 104
See application file for complete search history.

(56) References Cited

U.S. PATENT DOCUMENTS

| | | | | |
|---|---|---|---|---|
| 6,030,076 | A * | 2/2000 | Yoshimura et al. | 347/106 |
| 7,648,734 | B2 * | 1/2010 | Machida et al. | 427/209 |
| 8,177,354 | B2 * | 5/2012 | Sawada | 347/104 |
| 2011/0102531 | A1 * | 5/2011 | Ozaki et al. | 347/104 |

FOREIGN PATENT DOCUMENTS

| | | |
|---|---|---|
| JP | 61-237667 | 10/1986 |
| JP | 2009-234208 | 10/2009 |
| JP | 2009-279896 | 12/2009 |

* cited by examiner

*Primary Examiner* — Julian Huffman
(74) *Attorney, Agent, or Firm* — Workman Nydegger

(57) ABSTRACT

A recording apparatus includes: a medium support section which supports a recording medium by a medium support surface having a penetration portion; a recording process section which performs a recording process on the recording medium; a suction device which is connected to the medium support section and makes suction power act on the recording medium through the penetration portion; and a control section which controls driving of the suction device, wherein a mesh member of a convex shape which is provided so as to be related to the penetration portion and protrudes farther than the medium support surface is provided at the medium support section, and the mesh member is configured so as to be able to be elastically deformed when the suction power acts on the recording medium of the suction device.

5 Claims, 6 Drawing Sheets

RECORDING APPARATUS

INCORPORATION BY REFERENCE

This application claims the benefit of Japanese Patent Application No. 2011-056780, filed on Mar. 15, 2011, which is hereby incorporated by reference herein in its entirety.

BACKGROUND

1. Technical Field

The present invention relates to a recording apparatus.

2. Related Art

In a recording apparatus which forms a given image by discharging ink of a given color from a recording head to paper transported onto a platen, it is necessary to accurately secure the flatness of the paper. In a case where the flatness of paper cannot be accurately secured, the degree of landing precision of ink deteriorates, so that there is a possibility that a problem such as color unevenness may arise.

Therefore, in the past, a technique of improving the flatness of paper by forming a plurality of through-holes in a platen which faces a recording head and a transport belt which moves along the surface of the platen to transport paper and suctioning the paper by negative pressure through the through-holes, thereby making the paper follow the surface of the platen, has been disclosed.

Such a recording apparatus has a heater which promotes drying of ink discharged onto paper. Further, the platen which supports paper is made of metal such as aluminum. For this reason, during printing and drying of ink, heat conduction becomes different in a portion of the platen in which the through-holes are formed and the other portions, so that a problem of drying unevenness such as occurrence of marks of the through-holes in a printing surface arises. This is particularly conspicuous in a case where water-based ink is used. In this case, printing quality cannot be maintained.

In order to solve such a problem, there has been proposed a technique of avoiding drying unevenness by providing a metallic mesh plate which has an equivalent size to that of the platen and in which a plurality of holes or grooves smaller than the through-holes of the platen is formed therein, on the platen. The mesh plate has a very thin thickness compared to the platen.

JP-A-2009-234208 is an example of the related art.

However, a metallic mesh plate having an equivalent size to that of the platen is expensive, thereby incurring costs. Further, handling is also difficult due to the size or the thin thickness thereof.

SUMMARY

An advantage of some aspects of the invention is that it provides a recording apparatus in which it is possible to maintain recording quality by securing the flatness of paper and also preventing drying unevenness without incurring costs.

According to an aspect of the invention, there is provided a recording apparatus including: a medium support section which supports a recording medium by a medium support surface having a penetration portion; a recording process section which performs a recording process on the recording medium; a suction device which is connected to the medium support section and makes suction power act on the recording medium through the penetration portion; and a control section which controls driving of the suction device, wherein a mesh member of a convex shape which is provided so as to be related to the penetration portion and protrudes farther than the medium support surface is provided at the medium support section, and the mesh member is configured so as to be able to be elastically deformed when the suction power acts on the recording medium of the suction device.

According to this configuration of the above aspect, if suction power acts on the recording medium due to the suction device, the mesh member is elastically deformed so as to follow the recording medium by a suctioning and sticking force of the recording medium to the medium support surface, and as a result, it becomes possible to bring the recording medium into close contact with the medium support surface. In this way, floating of the recording medium from the medium support section is prevented, so that it is possible to maintain excellent printing quality.

Further, by providing the mesh member having elasticity so as to be related to the penetration portion, handling is easy compared to a metallic mesh plate of a size covering the entirety of a medium support surface, which has been provided in the past, and also a significant reduction in cost is possible.

Further, a heating device which dries liquid discharged from the recording process section toward the recording medium may be provided in the medium support section, and the medium support section and the mesh member may be formed by materials having approximately the same thermal conductivity.

According to this configuration, since thermal conductivity does not become different in an area of the medium support section in which the penetration portion is formed and the other areas, it is possible to uniformly heat the recording medium, so that it is possible to prevent drying unevenness of the recording medium. Further, a recording process operation of the recording medium can be promptly performed.

Further, the mesh member may be configured to be elastically deformed into a planar state so as to follow the medium support surface of the medium support section.

According to this configuration, since it is possible to support the recording medium in a flat state, it is possible to maintain excellent printing accuracy.

Further, a plurality of the penetration portions may be provided and the mesh member may be provided for each penetration portion.

According to this configuration, by locally providing the mesh member for each penetration portion rather than the entirety of a medium support member, it is possible to significantly reduce a cost required for the mesh member.

Further, the mesh member may have elasticity which is set according to an aperture ratio and the suction power of the suction device.

According to this configuration, plastic deformation of the mesh member is prevented, and the mesh member can elastically return to the original state in a case where the suction power of the suction device does not act thereon.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. In addition, in each drawing which is used in the following explanation, in order to show each member at a recognizable size, the scale of each member is appropriately changed.

First Embodiment

Figure 1:
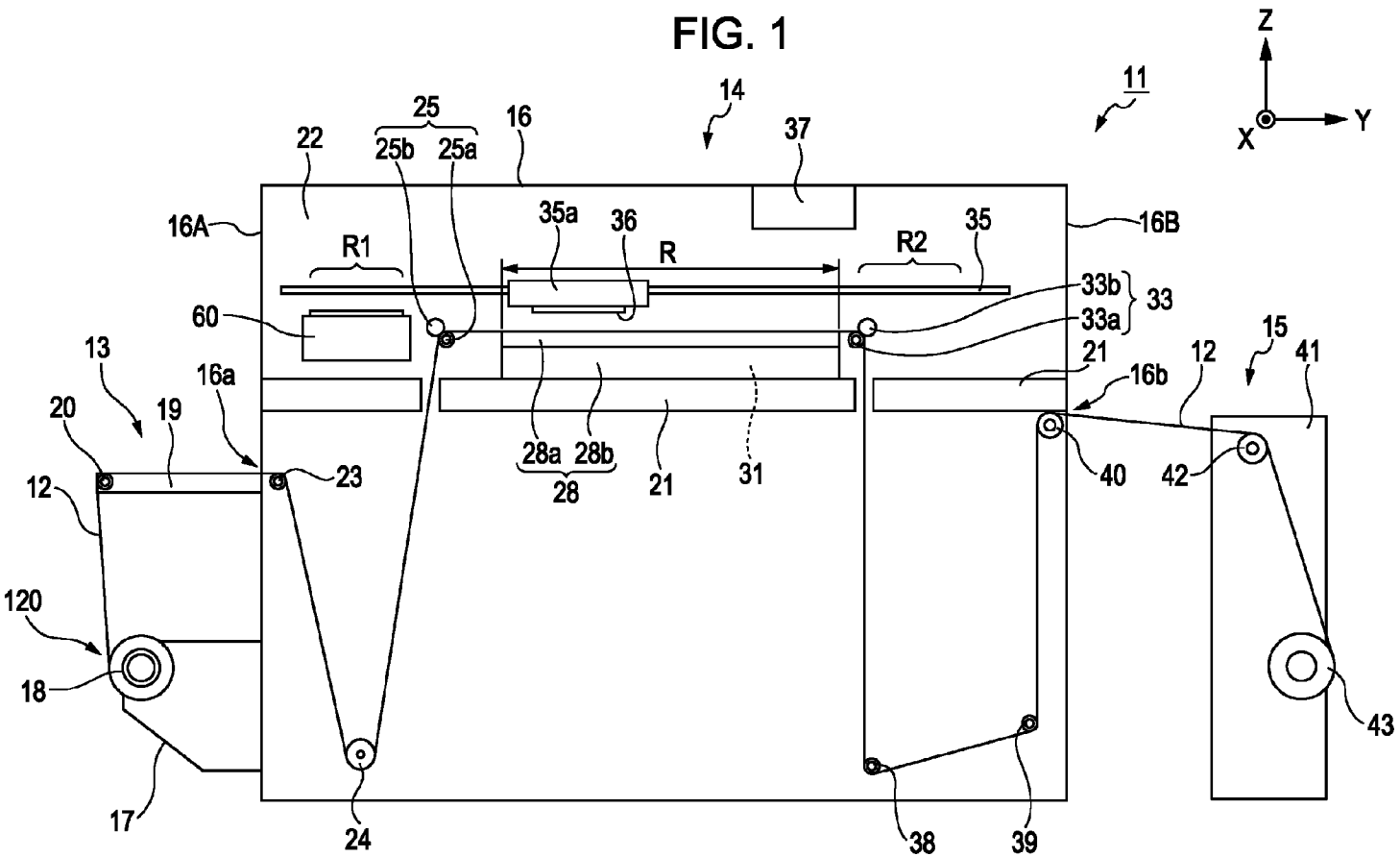
FIG. 1 is a diagram showing a schematic configuration of a printer related to an embodiment.
Figure 2:
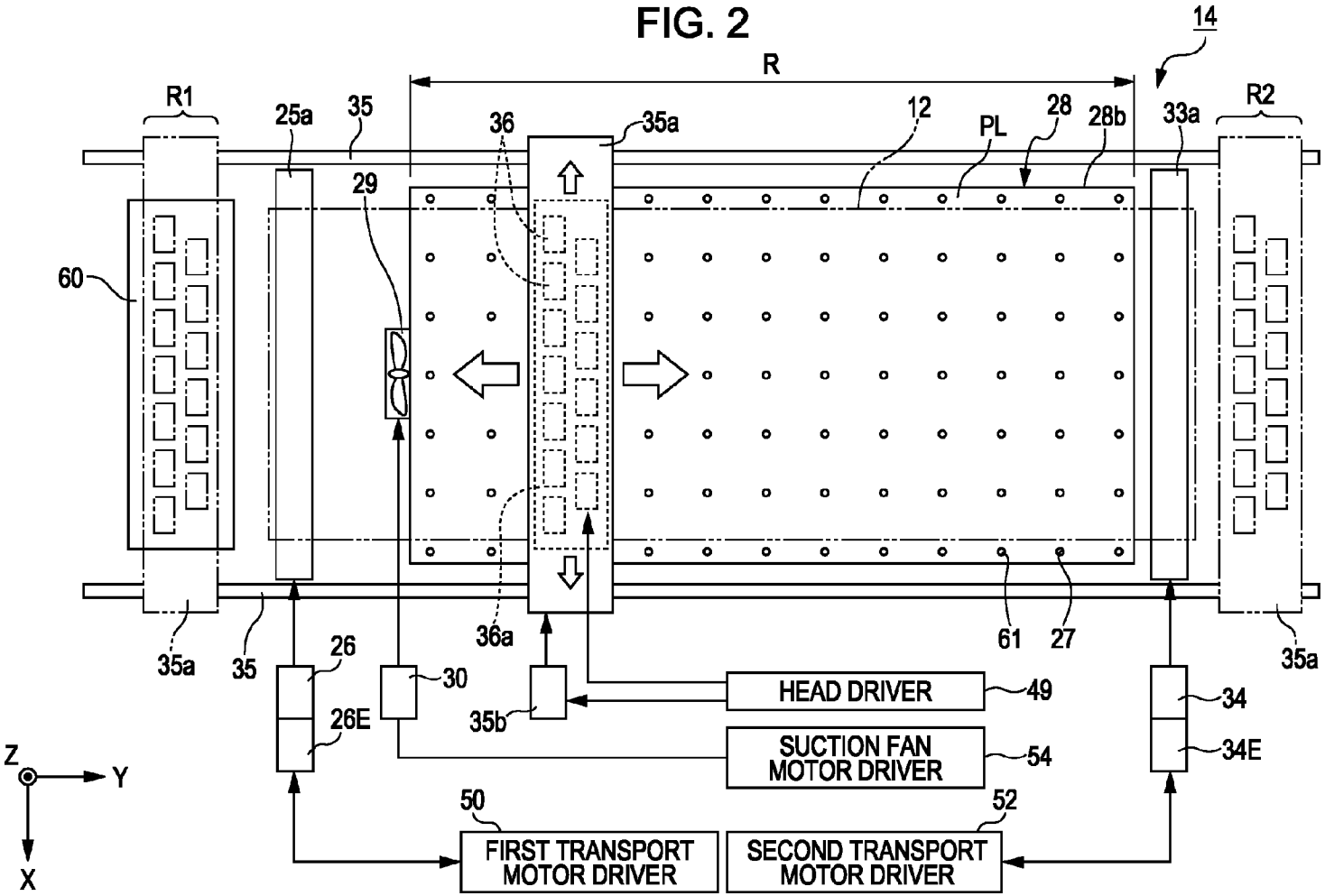
FIG. 2 is a plan view of a printing area in which printing is carried out in the printer.

FIG. 1 is a diagram illustrating a schematic configuration of a printer related to this embodiment. FIG. 2 is a plan view of a printing area in which printing is carried out in the printer.

As shown in FIG. 1, a printer (a recording apparatus) 11 adopts an ink jet method in which ink (liquid) is ejected from a plurality of recording heads 36 onto continuous paper (a recording medium) 12, as a printing method, and performs a printing process while sequentially feeding the long continuous paper 12 wound into a roll form and then winds the continuous paper 12 after printing into a roll form again.

In addition, in this embodiment, an X, Y, and Z orthogonal coordinate system is set in which the width direction of the continuous paper 12 in a horizontal plane is set to be an X direction, the transport direction of the continuous paper 12 perpendicular to the X direction is set to be a Y direction, and the vertical direction is set to be a Z direction.

The ink jet printer 11 includes a main body section 14 which carries out a printing process, a feed section 13 which supplies the continuous paper 12 to the main body section 14, and a take-up section 15 which takes up the continuous paper 12 that is discharged from the main body section 14.

The main body section 14 is provided with a main body case 16, the feed section 13 is installed on the upstream side (the −Y side) in the transport direction of the main body case 16, and the take-up section 15 is installed on the downstream side (the +Y side) in the transport direction of the main body case 16. While the feed section 13 is connected to a medium supply portion 16*a* provided at a side wall 16A on the upstream side (the −Y side) in the transport direction of the main body case 16, the take-up section 15 is connected to a medium discharge portion 16*b* provided at a side wall 16B on the downstream side (the +Y side) in the transport direction.

The feed section 13 is provided with a support plate (a support section) 17 mounted on a lower portion of the side wall 16A of the main body case 16, a winding shaft (a support section) 18 provided on the support plate 17, a feed table 19 connected to the medium supply portion 16*a* of the main body case 16, and a relay roller 20 provided at a leading end of the feed table 19. A roll body 120 is rotatably supported on the winding shaft 18. The roll body 120 is made by winding the long continuous paper 12 into the form of a roll around the axis of a paper tube (a shaft portion) 121 and supported in a state where the winding shaft 18 is inserted into the inside of the cylindrical paper tube 121.

Then, the continuous paper 12 fed from the winding shaft 18 (the roll body 120) is wound around the relay roller 20 to be turned to the upper surface of the feed table 19, and transported to the medium supply portion 16*a* along the upper surface of the feed table 19.

The take-up section 15 is provided with a take-up frame 41, a relay roller 42 provided at the take-up frame 41, and a take-up driving shaft 43. The continuous paper 12 which is discharged from the medium discharge portion 16*b* is wound around the relay roller 42, thereby being guided to the take-up driving shaft 43, and wound into the form of a roll by the rotational driving of the take-up driving shaft 43.

A plate-like base 21 is horizontally installed in the main body case 16 of the main body section 14, and the inside of the main body case is partitioned into two spaces by the base 21. A space above the base 21 is a printing chamber 22 in which a printing process is performed on the continuous paper 12. In the printing chamber 22, a platen (a medium support section) 28 fixed to the base 21, the recording heads (a recording process section) 36 provided above the platen 28, a carriage 35*a* which supports the recording heads 36, two guide shafts 35 (refer to FIG. 2) which support the carriage 35*a*, and a valve unit 37 are provided. The two guide shafts 35 are disposed parallel to each other along the transport direction (the Y direction) and configured such that the carriage 35*a* can reciprocate thereon in the transport direction.

As shown in FIGS. 1 and 2, the platen 28 has a support table 28*a* having a box shape, the upper surface of which is opened, and a placement plate 28*b* mounted on the opening of the support table 28*a*. The support table 28*a* is fixed to the upper surface of the base 21, and an inside enclosed by the support table 28*a* and the placement plate 28*b* becomes a negative pressure chamber 31. The continuous paper 12 is placed on a support surface (a medium support surface) PL (FIG. 2) of the placement place 28*b*.

A suction fan (a suction device) 29 is connected to the placement plate 28*b*. By performing suctioning on the inside of the negative pressure chamber 31 by the suction fan 29, suction power acts on the continuous paper 12 through a large number of suction holes (not shown) formed in the placement plate 28*b*, so that the continuous paper 12 can be suctioned and stuck to the support surface PL of the placement plate 28*b*, thereby being planarized.

In the placement plate 28*b* in this embodiment, a plurality of through-holes (penetration portions) 27 which penetrate the placement plate 28*b* in the thickness direction are formed over the entire plane direction of the placement plate 28*b*. A mesh member 61 is fitted in each through-hole 27, so that it is possible to improve the flatness of the continuous paper 12 at the time of suction.

A pressure detection sensor 32 (FIG. 3) which detects pressure in the negative pressure chamber 31 is connected to the platen 28. The pressure detection sensor 32 measures air pressure in the negative pressure chamber 31 and outputs the detected result to a suction fan motor driver 54 (FIG. 2).

On the upstream side (the −Y side) in the transport direction of the platen 28, a supply and transport system (a transport device) which includes a plurality of transport rollers is provided. The supply and transport system includes the winding shaft 18 which rotatably supports the roll body 120, a first transport roller pair 25 provided in the printing chamber 22 in the vicinity of the platen 28, a relay roller 24 provided in a space on the lower stage side of the main body case 16, and a relay roller 23 provided in the vicinity of the medium supply portion 16*a*.

The supply and transport system in this embodiment intermittently transports by a given range the continuous paper 12 onto the platen 28.

The first transport roller pair 25 is composed of a first driving roller 25*a* and a first driven roller 25*b*. A first transport motor 26 and a first encoder 26E are connected to the first driving roller 25*a*, as shown in FIG. 2.

In the supply and transport system, the continuous paper 12 brought in the main body case 16 from the feed section 13 through the medium supply portion 16*a* is wound around the first driving roller 25*a* from below by way of the relay rollers 23 and 24 and nipped by the first transport roller pair 25. Then, the continuous paper 12 is horizontally fed from the first transport roller pair 25 onto the support surface PL of the platen 28 in accordance with the rotation of the first driving roller 25*a* which is driven by the first transport motor 26.

On the other hand, on the downstream side (the +Y side) in the transport direction of the platen 28, a discharge and transport system which includes a plurality of transport rollers is provided. The discharge and transport system includes a second transport roller pair 33 provided on the opposite side to the first transport roller pair 25 with respect to the platen 28, an inversion roller 38 and a relay roller 39 provided in a space on the lower stage side of the main body case 16, and a delivery roller 40 provided in the vicinity of the medium discharge portion 16*b*.

The second transport roller pair 33 is composed of a second driving roller 33*a* and a second driven roller 33*b*. A second transport motor 34 and a second encoder 34E are connected to the second driving roller 33*a*, as shown in FIG. 2. In addition, since the second driven roller 33*b* is disposed on the printing surface side (the upper surface side) of the continuous paper 12, in order to avoid damage to a printed image, a configuration may also be made in which the second driven roller 33*b* comes into contact only with end edge portions in the width direction (the X direction) of the continuous paper 12.

In the discharge and transport system, the second transport roller pair 33 which has nipped the continuous paper 12 takes out the continuous paper 12 from the upper surface of the platen 28 in accordance with the rotation of the second driving roller 33*a* which is driven by the second transport motor 34. The continuous paper 12 fed from the second transport roller pair 33 is transported to the delivery roller 40 by way of the inversion roller 38 and the relay roller 39 and fed to the take-up section 15 through the medium discharge portion 16*b* by the delivery roller 40.

In the case of this embodiment, the plurality of recording heads 36 is mounted on the carriage 35*a* through a head mounting plate 36*a*. The head mounting plate 36*a* is configured so as to be able to move in the medium width direction (the X direction) on the carriage 35*a*. The position of the head mounting plate 36*a* can be controlled by a head position control section 35*b* connected to the carriage 35*a*, and by moving the head mounting plate 36*a* in the medium width direction (the X direction), it is possible to perform an integral linefeed operation of the plurality of recording heads 36. The recording heads 36 are disposed side by side at regular intervals in the medium width direction on the head mounting plate 36*a* such that adjacent recording heads 36 are staggered in two stages in the medium transport direction (the Y direction).

In addition, the head position control section 35*b* performs position control in the medium width direction (the X direction) of the recording heads 36 and also position control in the medium transport direction (the Y direction: a head scanning direction) of the carriage 35*a*, thereby being able to dispose the recording heads 36 at desired positions on the continuous paper 12.

The plurality of recording heads 36 are connected to the valve unit 37 through the respective ink supply tubes (not shown). The valve unit 37 is provided on an inner wall of the main body case 16 in the printing chamber 22 and connected to an ink tank (an ink storage section) (not shown). The valve unit 37 supplies ink which is supplied from the ink tank, to the recording heads 36 while temporarily retaining the ink.

In the lower surface (a nozzle formation surface) of each recording head 36, a large number of ink discharge nozzles are provided in a row in the medium width direction (the X direction). The recording heads 36 eject ink which is supplied from the valve unit 37, from the ink discharge nozzles toward the continuous paper 12 on the platen 28, thereby performing printing.

In addition, each recording head 36 may also have a plurality of ink discharge nozzle rows. In this case, when performing four-color or six-color printing, if ink is assigned to each ink discharge nozzle row for each type of a color, it becomes possible to eject ink of plural colors by a single recording head 36.

An area on the platen 28 in the printing chamber 22 is a printing area R in which printing is performed on the continuous paper 12 by ejection of ink from the ink discharge nozzles. The continuous paper 12 is intermittently transported by the supply and transport system and the discharge and transport system described above. Specifically, every time printing is performed, the continuous paper 12 of a length equivalent to the printing area R is loaded on the platen 28, and after the printing process, the continuous paper 12 is sent to the discharge and transport system.

The guide shafts 35 extending into the printing chamber 22 extend further to the outside in the medium transport direction than the printing area R, as shown in FIGS. 1 and 2. In this way, the carriage 35*a* can move to an area outside the printing area R. A first maintenance area R1 is provided on the upstream side (the −Y side) in the medium transport direction of the printing area R, and a second maintenance area R2 is provided on the downstream side (the +Y side) in the medium transport direction.

In the first maintenance area R1, a maintenance unit 60 is provided. The maintenance unit 60 has, for example, a configuration which includes a cap member and a wiping member provided corresponding to each recording head 36, and a suction device which is connected to the cap member and suctions the inside of the cap member.

In the second maintenance area R2, a maintenance unit or the like is not provided, and the second maintenance area R2 becomes a work space allowing the hand or the arm of a worker to be inserted therein. By disposing the carriage 35*a* in the second maintenance area R2, the nozzle formation surfaces of the recording heads 36 can be exposed into the work space, so that cleaning of the nozzle formation surfaces, replacement work of the recording head 36, or the like by a worker becomes possible.

The continuous paper 12 after the printing process may also be subjected to natural drying during transport in the discharge and transport system. However, in this embodiment, a configuration is provided in which a heating device for forcibly drying and fixing ink to the continuous paper 12 is provided, and here, as the heating device, a platen heater (a heating device) 56 which heats the placement plate 28*b* is provided at the platen 28. The platen heater 56 is connected to the placement plate 28*b* and controlled depending on the temperature of the placement plate 28*b* which is measured by a temperature sensor 57 likewise connected to the placement plate 28*b*.

Provided that it is possible to uniformly heat the entire placement surface of the placement plate 28*b* which supports the continuous paper 12, the configuration, material, and the like of the platen heater 56 are not limited. By improving fixing of ink to the medium by such a platen heater 56, improvement in printing quality or printing speed can be supported.

In addition, a configuration is also acceptable in which a heating device is provided in the discharge and transport system.

Figure 3:
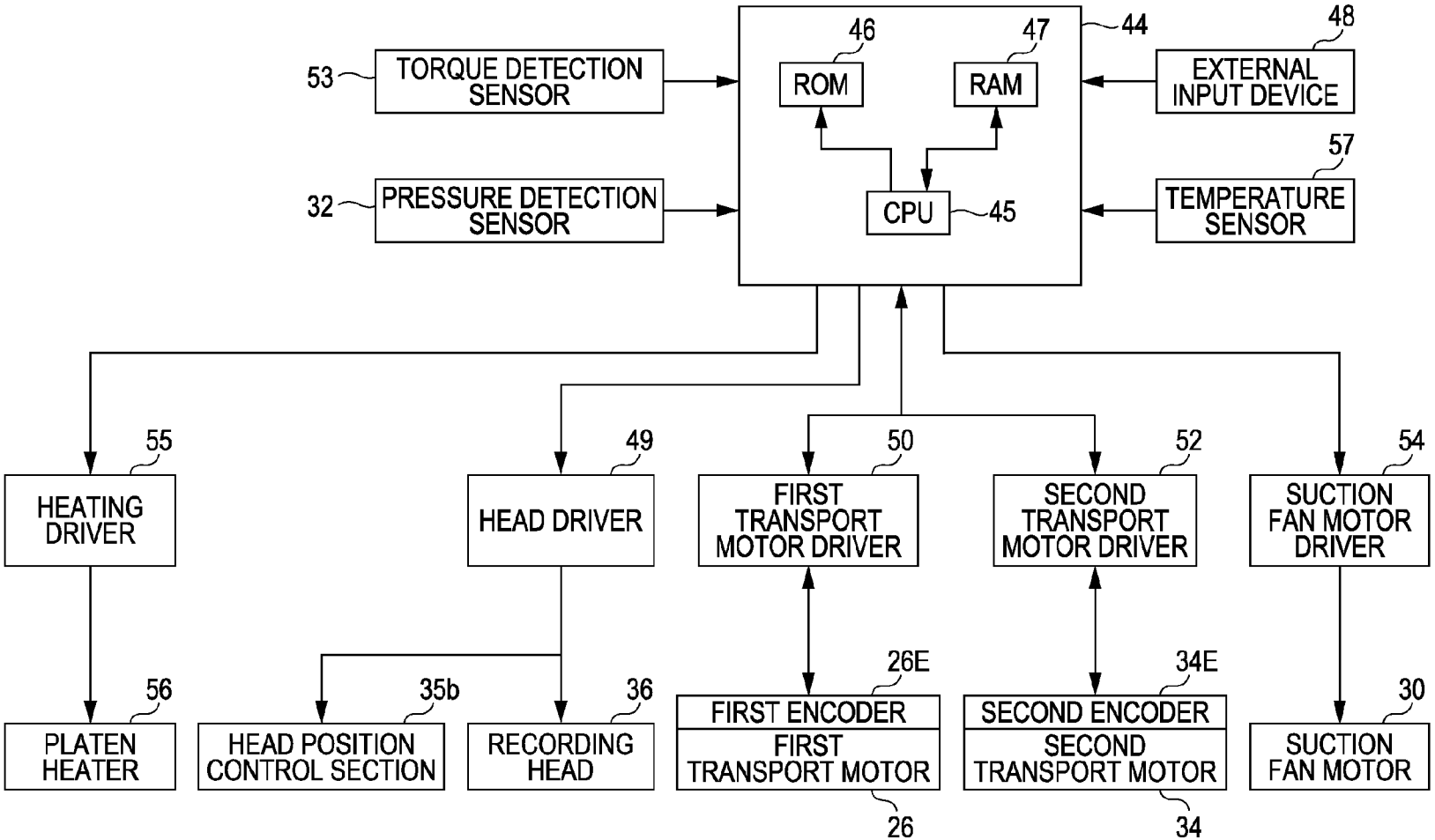
FIG. 3 is a functional block diagram of an ink jet printer.

Next, FIG. 3 is a functional block diagram of the ink jet printer.

As shown in FIG. 3, the ink jet printer 11 is provided with a controller (a control section) 44 which controls the driving state of the entirety of the apparatus. The controller 44 is provided with a CPU 45 which is a central processing device, a ROM 46, and a RAM 47. In the ROM 46, a program or the like of a processing routine relating to a printing process and a transport process is recorded. Further, the RAM 47 is used as a temporary storage area of operation results in the CPU 45 or a temporary storage area of printing data or the like which is input from an external input device 48.

A head driver 49, a first transport motor driver (a first motor control section) 50, a second transport motor driver (a second motor control section) 52, the suction fan motor driver 54, a torque detection sensor 53, the pressure detection sensor 32, the external input device 48, a heating driver 55, and the temperature sensor 57 are connected to the controller 44.

The plurality of recording heads 36 and the head position control section 35*b* are connected to the head driver 49. In the printing process, the controller 44 reads the printing data input from the external input device 48 from the RAM 47 and sends the read-out printing data to the head driver 49. The head driver 49 drives the recording heads 36 and the head position control section 35*b* on the basis of the printing data received from the controller 44, thereby ejecting ink droplets from the ink discharge nozzles of the recording heads 36 while controlling the positions of the recording heads 36 on the continuous paper 12, whereby an image is formed on the continuous paper 12.

The first transport motor driver 50 detects the amount of rotation of the first transport motor 26 on the basis of a count signal which is output from the first encoder 26E connected to the first transport motor 26 and performs feedback control of the amount of rotation of the first transport motor 26. That is, the first transport motor driver 50 rotationally drives the first driving roller 25*a* by the first transport motor 26 until a given transport length input from the controller 44 is reached, thereby feeding the continuous paper 12 from the first transport motor pair 25 onto the platen 28.

On the other hand, the second transport motor driver 52 drives the second transport motor 34 by torque control on the basis of a control signal which is input from the controller 44. In this embodiment, the torque detection sensor 53 which detects the torque of the second transport motor 34 is connected to the controller 44 and the controller 44 performs feedback control of the torque of the second transport motor 34 through the second transport motor driver 52 on the basis of the detected result of the torque of the second transport motor 34 which is output from the torque detection sensor 53. In this way, given tension based on the torque of the second transport motor 34 is imparted to the continuous paper 12 through the second driving roller 33*a*.

In addition, in general, in a motor, since torque and an electric current have approximately a proportional relationship, if the rotating speed of the motor is constant, the magnitude of an electric current is determined depending on a load of the motor. That is, the magnitude of an electric current required for driving of the motor is determined depending on a load which is applied to a roller. Therefore, by detecting the magnitude of an electric current flowing through the motor, it is possible to detect the magnitude of a load which is loaded to the motor.

The suction fan motor driver 54 controls driving of a suction fan motor 30 connected to a rotary shaft of the suction fan 29 on the basis of a control signal which is input from the controller 44. By rotating the suction fan 29 at a given speed by the driving force of the suction fan motor 30, it is possible to decompress the inside of the negative pressure chamber 31 by given suction power based on a rotating speed. As a result, negative pressure in the negative pressure chamber 31 acts as a suctioning and sticking force of the continuous paper 12 to the support surface PL of the platen 28 through a large number of suction holes (not shown) provided in the placement plate 28*b*.

The heating driver 55 controls driving of the platen heater 56 on the basis of a control signal which is input from the controller 44. The temperature of the platen 28 is measured by the temperature sensor 57 that the platen heater 56 has, and the result is output to the controller 44. In this way, at the time of an image forming operation, depending on the operation state of the ink jet printer 11 or the continuous paper 12, the temperature of the platen 28 is appropriately set to and maintained at a temperature suitable for drying of ink. Further, in an operation state other than the time of the image forming operation, supply of electric power to the platen heater 56 is stopped or the temperature of the platen 28 is maintained at a temperature (a temperature lower than that at the time of the image forming operation) considering a rise time at the time of the start of the image forming operation.

Next, the configuration of the platen in the ink jet printer related to this embodiment will be described with a focus on the placement plate.

Figure 4:
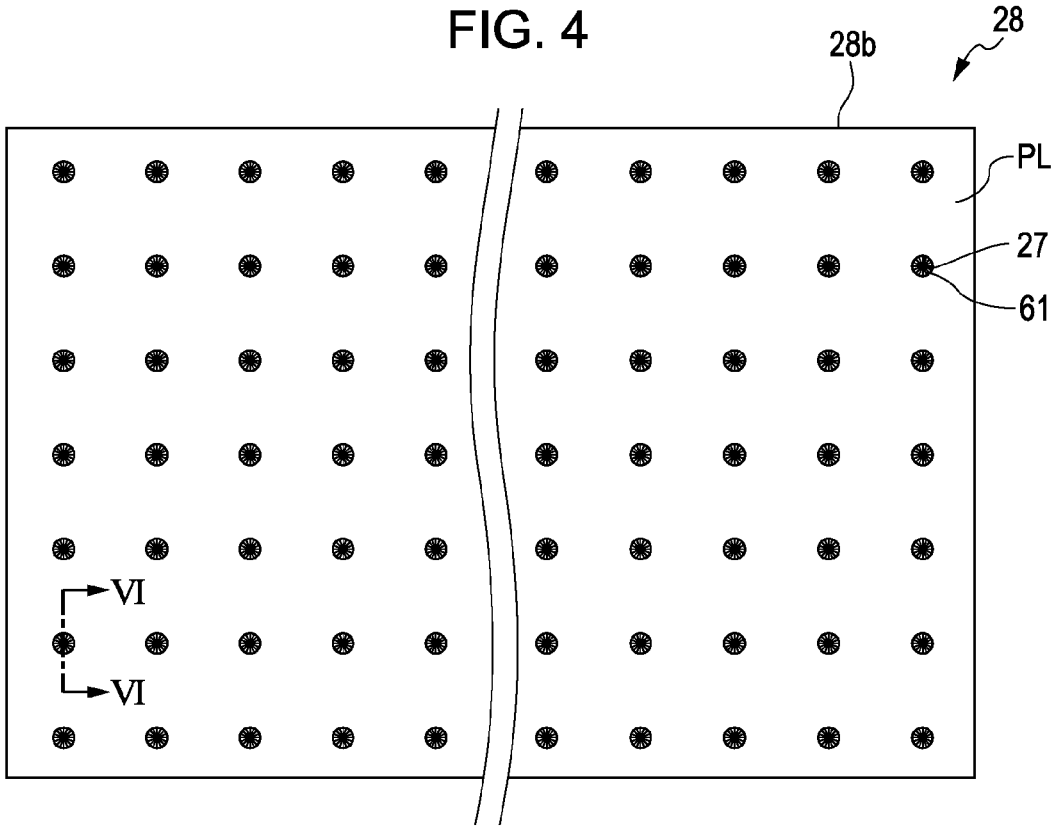
FIG. 4 is a plan view showing the configuration of a placement plate in the embodiment.
Figure 5:
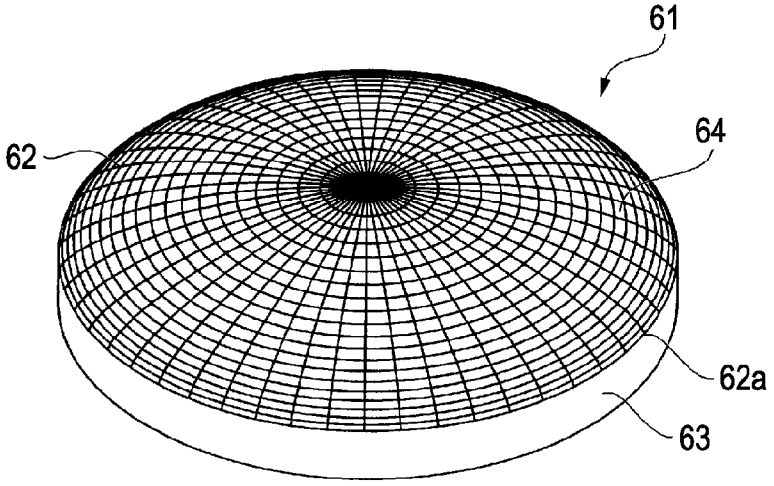
FIG. 5 is a perspective view showing the configuration of a mesh member.
Figure 6:
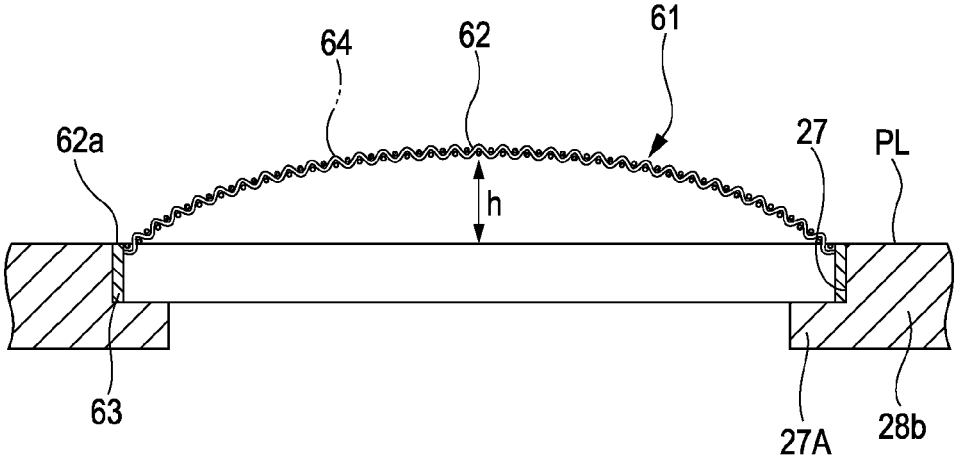
FIG. 6 is a cross-sectional view taken along line VI-VI of FIG. 4.
Figure 7:
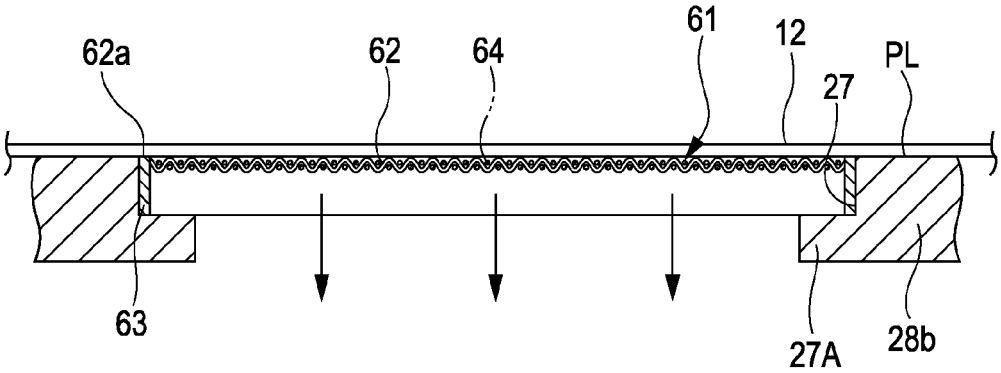
FIG. 7 is a view showing the deformed state of the mesh member at the time of a printing operation.

FIG. 4 is a plan view showing the configuration of the placement plate in the embodiment, and FIG. 5 is a perspective view showing the configuration of the mesh member. FIG. 6 is a cross-sectional view taken along line VI-VI of FIG. 4. Further, FIG. 7 is a view showing the deformed state of the mesh member at the time of a printing operation.

As shown in FIG. 4, in the placement plate 28*b* constituting the platen 28, the plurality of through-holes 27 each exhibiting a circular shape in a plan view are perforated at equally-spaced intervals on the entirety in the plane direction. The number, disposition interval, or the like of through-holes 27 is appropriately set depending on the type, the size, or the like of the continuous paper 12 so as to be able to bring the entirety of the continuous paper 12 into close contact with the support surface PL of the placement plate 28*b* at the time of suction. The diameter of each through-hole 27 is in a range of 2 mm to 5 mm. Then, the mesh member 61 is fitted in each through-hole 27.

The mesh member 61 is composed of a convex elastic deformation portion 62 exhibiting a circular shape in a plan view and a support portion 63 drooping from a periphery 62*a* of the elastic deformation portion 62, and fixed in a state where the lower end side of the support portion 63 is locked to a locking portion 27A in the through-hole 27. The height of the periphery 62*a* (the upper end of the support portion 63) of the elastic deformation portion 62 of the mesh member 61 fixed in the through-hole 27 and the height of the support surface PL of the placement plate 28*b* coincide with each other, and a configuration is made such that the entirety of the elastic deformation portion 62 protruding further to the outside than the support surface PL is elastically deformed.

As a material of the mesh member 61, the same material as that of the placement plate 28*b* is used, and here, aluminum having high thermal conductivity is used. The mesh member 61 is made of the same material as that of the placement plate 28*b*, whereby the mesh member 61 has the same thermal conductivity as that of the placement plate 28*b*. In addition, in addition to aluminum, a metal such as gold, silver, or copper can also be used.

Here, with respect to the continuous paper 12 having a thickness in a range of 0.1 mm to 0.4 mm, the thickness of an aluminum plate constituting the mesh member 61 is 0.3 μm and the diameter of each of a large number of minute holes 64 is about 0.3 μm. Further, the aperture ratio of the mesh member 61 is set depending on the hole diameter (an opening area) of the minute hole 64 and the suction power of the suction fan 29.

The mesh member 61 has stiffness and an elastic restoring force allowing the mesh member 61 to be elastically deformed flat so as to follow the continuous paper 12 when the suction power of the suction fan 29 is applied thereto at the time of the printing process, and the spring property thereof can be adjusted by the plate thickness of a base material, an aperture ratio, the disposition intervals of the minute holes 64, or the like, and a height h of a convex portion is set to be a height which falls within a range in which when suction power is applied, plastic deformation does not occur and in a case where the suction power of the suction fan 29 does not act, elastic return to the original state can occur.

In order to try to make the elastic deformation portion 62 of the mesh member 61 into a planar shape, high surface accuracy is required, so that working is difficult. In this embodiment, by making the shape of the elastic deformation portion 62 into the form of a dome (a convex shape), it is possible to impart a spring property deforming the elastic deformation portion 62 by the suction power of the suction fan 29 at the time of the printing process. For this reason, formation of an air layer between the continuous paper 12 and the support surface PL can be prevented.

In addition, in this embodiment, a configuration has been described in which the large number of minute holes 64 each exhibiting a circular shape in a plan view are formed in the elastic deformation portion 62 of the mesh member 61. However, it is not limited thereto and a configuration is also acceptable in which a large number of slit-like grooves are formed. In this case, the extending direction of the groove may also be configured so as to follow either of the longitudinal direction (the transport direction of the continuous paper 12) and the short-side direction (a direction perpendicular to the transport direction of the continuous paper 12) of the placement plate 28*b*, and the length thereof, a pitch, or the like may also be appropriately set.

Next, an operation of the ink jet printer will be described.

First, if printing data which is used for printing to the continuous paper 12 is input from the external input device 48 to the RAM 47 and the printing data is input to the recording heads 36 through the head driver 49, the controller 44 executes a program relating to the transport process and the printing process.

The controller 44 drives the first transport motor 26 and the second transport motor 34, thereby feeding the continuous paper 12 and placing it on the platen 28.

Next, if the controller 44 sends a control signal to the suction fan motor driver 54, the suction fan 29 starts rotational driving in accordance with rotational driving of the suction fan motor 30, whereby negative pressure is created in the negative pressure chamber 31. As a result, a suctioning and sticking force acts on the continuous paper 12 on the support surface PL of the platen 28 from the inside of the negative pressure chamber 31 through the through-holes 27 formed in the placement plate 28*b*. In this case, the continuous paper 12 is suctioned and stuck to the support surface PL of the platen 28 by a suctioning and sticking force approximately equal to the suction power of the suction fan 29.

Then, before the printing process to the continuous paper 12 is started, the controller 44 drives the platen heater 56 through the heating driver 55, thereby heating the placement plate 28*b* to a given temperature. The temperature of the placement plate 28*b* is measured by the temperature sensor 57 and the output of the heating driver 55 is controlled on the basis of the result.

Thereafter, printing is performed by ejecting ink from each nozzle opening (not shown) of the recording heads 36 toward the continuous paper 12 supported on the platen 28 while the carriage 35*a* performs single reciprocation in the left-and-right direction in the printing area R of the continuous paper 12 by driving of a carriage motor. At this time, the controller 44 stops driving of the first transport motor 26 and the second transport motor 34 only for a given printing process time, thereby stopping transport of the continuous paper 12, and after the completion of printing, the controller 44 drives the first transport motor 26 and the second transport motor 34 for a given transport time, thereby transporting the continuous paper 12 for a single-printing length to the downstream side by the first transport roller pair 25 and the second transport roller pair 33. Ink discharged onto the continuous paper 12 is dried while the continuous paper 12 is placed on the heated platen 28 (during the printing process) or in a process in which the continuous paper 12 passes on the platen 28.

If the continuous paper 12 is transported further to the downstream side than the platen 28, a pressing force to the elastic deformation portion 62 of the mesh member 61 is released, so that the elastic deformation portion 62 elastically returns to the original convex state.

Thereafter, the next printing is performed.

As described above, in the ink jet printer 11 related to this embodiment, at the time of the printing process, the continuous paper 12 is suctioned and stuck to the support surface PL of the platen 28 (the placement plate 28*b*) by using the suction power of the suction fan 29. At this time, the suction power acts on the continuous paper 12 through the large number of through-holes 27 of the placement plate 28*b*, so that the continuous paper 12 is suctioned and stuck to the support surface PL. However, in each through-hole 27, the mesh member 61 of a convex shape protruding from the support surface PL is provided.

The mesh member 61 is made such that a suctioning and sticking force of the continuous paper 12 to the support surface PL or the tension of the continuous paper 12 acts on the continuous paper 12 by the suction power of the suction fan 29, whereby the elastic deformation portion 62 is pressed down, thereby being deformed flat. At this time, the elastic deformation portion 62 is elastically deformed to a planar state where it is approximately flush with the support surface PL to follow the continuous paper 12, and this state is maintained during the printing process, whereby floating of the continuous paper 12 from the support surface PL is prevented, so that the continuous paper 12 can be maintained in a state suitable for printing.

In addition, the elastic deformation portion 62 is not deformed further to the inside of the through-hole 27 than the support surface PL.

Further, as described above, if an elastic deformation portion is of a planar shape, in a case where the surface accuracy thereof is insufficient, an air layer is formed between the elastic deformation portion and the continuous paper 12. That is, if a printing process is carried out in a state where the continuous paper 12 floats from the platen 28, since image quality deteriorates, it is necessary to bring the entire printing area in the continuous paper 12 into close contact with the support surface PL.

In the mesh member 61 in this embodiment, since the elastic deformation portion 62 is formed in a convex shape and configured so as to be able to be elastically deformed, an air layer is not formed between the elastic deformation portion 62 and the continuous paper 12 and it is possible to bring the entire printing area of the continuous paper 12 into close contact with the support surface PL of the platen 28. In this way, contact of the continuous paper 12 floating from the platen 28 with the recording heads 36 or wrinkling of ink landed on the continuous paper 12 does not occur, so that high printing quality can be maintained.

Further, the platen 28 (the placement plate 28*b*) heated to a given temperature by the platen heater 56 promotes drying of ink discharged onto the continuous paper 12. Since the mesh member 61 provided in each through-hole 27 of the placement plate 28*b* is made of the same material as that of the placement plate 28*b*, the thermal conductivity thereof is also the same as that of the placement plate 28*b*. For this reason, in the platen 28, since thermal conductivity does not differ in an area where the through-holes 27 are formed and the other areas and it is possible to make heat supply uniform, occurrence of drying unevenness in the continuous paper 12 is prevented. In this way, it is possible to heat the entirety of the platen 28 (the placement plate 28*b*) at a uniform temperature. As a result, it is possible to eliminate marks of through-holes which have been formed due to a difference in thermal conductivity between an area where the through-holes are formed and the other areas in the plane of the support surface PL in the past, so that it is possible to secure excellent printing quality. Further, drying is further promoted, so that a printing process can be promptly performed.

Further, rather than a configuration as in the past in which a large-sized mesh member is provided on a platen, in this embodiment, since a configuration is made such that the mesh member 61 of a size corresponding to the size of each through-hole 27 formed in the platen 28 is provided in each through-hole 27, it is possible to suppress material costs or manufacturing costs, so that it is possible to realize a significant reduction in cost.

Further, even in a configuration in which the mesh members are locally disposed as in this embodiment, it is possible to maintain the entirety in the width direction (a direction perpendicular to the transport direction) of the continuous paper 12 in a planar state.

In addition, in this embodiment, the configuration of a printer in which continuous paper is used as the record medium has been described. However, a printer coping with cut paper cut into a given size is also acceptable.

Further, in a case where a recording medium having a thin thickness is used, even if the suction power of the suction fan 29 acts on the recording medium, tension (a suctioning and sticking force) sufficient to elastically deform the mesh member 61 is not imparted to the recording medium and the recording medium comes into close contact with the elastic deformation portion 62 so as to follow the convex shape of the elastic deformation portion 62. In order to avoid this, a configuration may also be made such that a plurality of mesh members 61 which are different in plate thickness, aperture ratio, stiffness, or the like is prepared in advance and replaced as appropriate depending on the type of a recoded medium which is used. In addition, a method of adjusting the stiffness of the mesh member is not limited to the above.

Second Embodiment

Next, an ink jet printer related to the second embodiment of the invention will be described with a focus on the configuration of a platen.

Figure 8A:
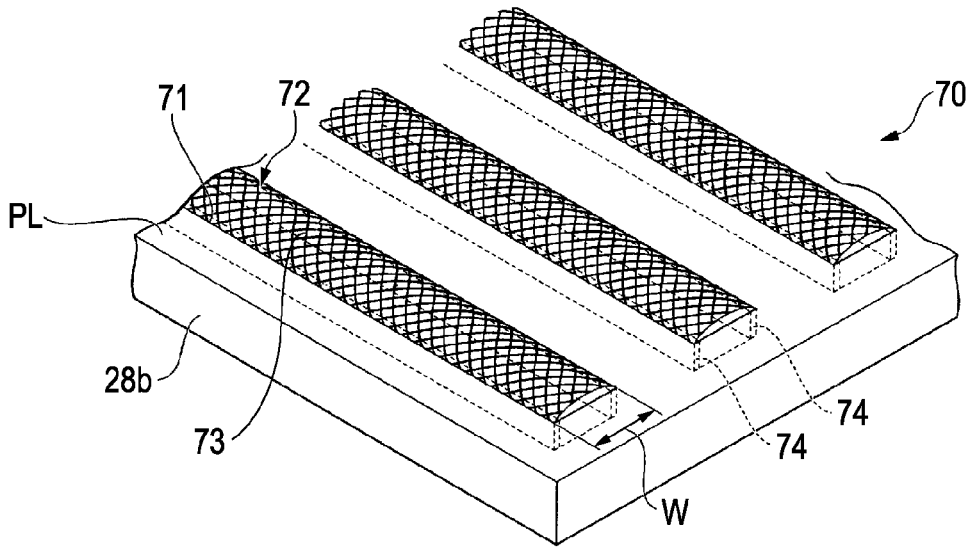
FIG. 8A is a perspective view showing the configuration of a platen in a second embodiment and FIG. 8B is a perspective view showing the configuration of a mesh member in the second embodiment.
Figure 8B:
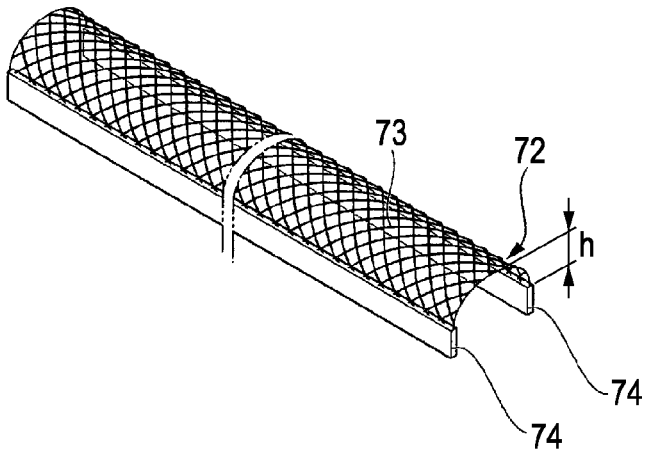

FIG. 8A is a perspective view showing the configuration of a platen in the second embodiment, and FIG. 8B is a perspective view showing the configuration of a mesh member in the second embodiment.

As shown in FIGS. 8A and 8B, a platen 70 in this embodiment is provided with the placement plate 28*b* having a plurality of grooves (penetration portions) 71 extending in a longitudinal direction (the transport direction of the continuous paper 12) and also configured in slit shapes at given intervals in a short-side direction (a direction crossing the transport direction of the continuous paper 12). The groove 71 is formed to penetrate the placement plate 28*b* in the thickness direction and the width W thereof is in a range of 2 mm to 5 mm.

In each groove 71, a mesh member 72 having a convex shape in a cross-section view as viewed from an extending direction is provided. The mesh member 72 is composed of an elastic deformation member 73 configured so as to describe an arc in the width direction and a pair of support portions 74 and 74 provided at side portions on both sides in the short-side direction thereof, and fixed in the groove 71 in a state where the elastic deformation member 73 protrudes further to the outside than the support surface PL of the platen 70.

In addition, the pair of support portions 74 and 74 may also be configured so as to be integrally formed.

Then, the elastic deformation member 73 of the mesh member 72 is elastically deformed flat by the suction power of the suction fan 29, which is imparted thereto at the time of a printing operation, and the tension of the continuous paper 12. In this way, the continuous paper 12 on the support surface PL is supported in a flat state, so that excellent printing accuracy can be obtained.

Even in the configuration related to this embodiment, it is possible to obtain the same effects as the above. Further, since the number of mesh members 72 can be reduced, handling becomes easy, so that productivity is improved.

In addition, in this embodiment, a configuration is also acceptable in which the convex volume (a height h) of the elastic deformation member 73 of the mesh member 72 can be adjusted. For example, this can be realized by applying a configuration in which both the support portions 74 and 74 of the mesh member 72 can come close to each other or be separated from each other, to the platen 70.

The preferred embodiments related to the invention have been described above referring to the accompanying drawings. However, it goes without saying that the invention is not limited to such examples. It will be apparent to those skilled in the art that various changed examples or modification examples can be contemplated within the scope of the technical idea stated in the appended claims, and it is to be understood that these examples naturally also belong to the technical scope of the invention.

In the previous embodiments, a configuration has been described in which the mesh member 61 exhibiting a circular shape in a plan view or the mesh member 72 of an approximately semi-cylindrical shape having a given length is provided in the through-hole 27 or the groove 71 formed in the placement plate 28*b* of the platen. However, the configuration of the placement plate 28*b* or the mesh member is not limited thereto and can be changed appropriately.

In the above-described embodiments, as the recording apparatus, a recording apparatus which ejects liquid such as ink has been described as an example. However, it is possible to apply the invention to a recording apparatus which ejects or discharges liquid other than ink. Liquid that a recording apparatus can eject includes a liquid body in which particles of functional materials are dispersed or dissolved, and a gel-like fluid body.

Further, in the above-described embodiments, as liquid which is ejected from the recording apparatus, not only ink, but also liquid corresponding to a specific use can be applied. By providing an ejecting head capable of ejecting liquid corresponding to a specific use in a recording apparatus and ejecting the liquid corresponding to a specific use from the ejecting head, thereby attaching the liquid to a given object, a given device can be manufactured. As the recording apparatus, for example, a recording apparatus which ejects liquid (a liquid body) in which a material such as an electrode material or a color material which is used for the manufacturing or the like of a liquid crystal display, an EL (electroluminescence) display, and a surface-emitting display (FED) is dispersed (dissolved) in a given dispersion medium (solvent) can be applied.

Further, as the recording apparatus, a recording apparatus which ejects a biological organic matter that is used for the manufacturing of a biochip or a recording apparatus which is used as a precision pipette and ejects liquid that is a sample is also acceptable.

Further, a recording apparatus which ejects lubricant to a precision machine such as a clock or a camera by a pin point, a recording apparatus which ejects transparent resin solution such as ultraviolet curing resin onto a substrate in order to form a hemispherical micro-lens (an optical lens) or the like which is used in an optical communication element or the like, a recording apparatus which ejects etching solution such as acid or alkali in order to etch a substrate or the like, and a liquid body ejecting apparatus which ejects gel are also acceptable. Then, the invention can be applied to any type of recording apparatus among these apparatuses.

What is claimed is:

1. A recording apparatus comprising:

a medium support section which supports a recording medium by a medium support surface having a penetration portion;

a recording process section which performs a recording process on the recording medium;

a suction device which is connected to the medium support section and makes suction power act on the recording medium through the penetration portion; and a control section which controls driving of the suction device, wherein a mesh member of a convex shape which is provided so as to be related to the penetration portion and protrudes farther than the medium support surface is provided at the medium support section, and the mesh member is configured so as to be able to be elastically deformed when the suction power acts on the recording medium due to the suction device.

2. The recording apparatus according to claim 1, wherein a heating device which dries liquid discharged from the recording process section toward the recording medium is provided in the medium support section, and the medium support section and the mesh member are formed by materials having approximately the same thermal conductivity.

3. The recording apparatus according to claim 1, wherein the mesh member is configured to be elastically deformed into a planar state so as to follow the medium support surface of the medium support section.

4. The recording apparatus according to claim 1, wherein a plurality of the penetration portions is provided and the mesh member is provided for each penetration portion.

5. The recording apparatus according to claim 1, wherein the mesh member has elasticity which is set according to an aperture ratio and the suction power of the suction device.

* * * * *